US005862850A

United States Patent [19]

Yang

[11] Patent Number: 5,862,850

[45] **Date of Patent: *Jan. 26, 1999**

[54] SHADE LIFT APPARATUS

[76] Inventor: Nelson T. G. Yang, 9 Swans Mill La., Scotch Plains, N.J. 07076

[ * ] Notice: This patent issued on a continued prosecution application filed under 37 CFR 1.53(d), and is subject to the twenty year patent term provisions of 35 U.S.C. 154(a)(2).

[21] Appl. No.: 677,270

[22] Filed: Jul. 9, 1996

[51] Int. Cl.[6] ..... A47H 5/00

[52] U.S. Cl. ..... 160/84.04; 160/84.01; 160/264; 160/178.3 R; 160/178.1 R; 24/462

[58] Field of Search ..... 160/84.01, 84.04, 160/264, 178.3 R, 178.1 R; 24/462, 459, 570, 67.9

[56] References Cited

U.S. PATENT DOCUMENTS

| | | | |
|---|---|---|---|
| 2,037,393 | 4/1936 | Roberts | 160/178.3 R X |
| 2,633,909 | 4/1953 | Foglio | 160/178.3 R |
| 3,045,310 | 7/1962 | Velinsky | 24/462 |
| 3,141,221 | 7/1964 | Faulls, Jr. | 24/462 X |
| 3,527,284 | 9/1970 | Nelson et al. | 24/462 X |
| 3,750,740 | 8/1973 | Newman . | |
| 4,907,635 | 3/1990 | Bunger et al. | 160/84.04 |
| 4,934,435 | 6/1990 | Regev | 160/84.04 |
| 5,072,767 | 12/1991 | Kraeutler . | |
| 5,199,479 | 4/1993 | Kraeutler . | |
| 5,207,256 | 5/1993 | Kraeutler . | |
| 5,265,373 | 11/1993 | Vollebregt . | |
| 5,273,096 | 12/1993 | Thomsen et al. . | |
| 5,566,735 | 10/1996 | Jelic | 160/84.04 |
| 5,690,156 | 11/1997 | Ruggles | 160/84.04 |

*Primary Examiner*—Blair M. Johnson
*Assistant Examiner*—Bruce A. Lev
*Attorney, Agent, or Firm*—Plevy & Associates

[57] ABSTRACT

An apparatus for lifting and folding a sheet of material used as a window covering, having a headrail for attaching the apparatus adjacent to a window, a pair of spaced apart straps extending vertically from the headrail, a plurality of rods extending horizontally between the straps which are operative for affixing the sheet of material to the apparatus. The apparatus also includes a first plurality of clips for attaching the sheet of fabric material to the rods. Each of the clips is adapted for coupling the rods to the straps at a plurality of vertically spaced apart locations along the straps to provide a plurality of folds in the sheet of material. A second plurality of clips are also provided for attaching the sheet of material to the ends of the rods while the first plurality of clips are used for attaching the sheet of material at locations remote from the ends of said rods.

15 Claims, 5 Drawing Sheets

SHADE LIFT APPARATUS

FIELD OF INVENTION

The present invention relates generally to shades, blinds, curtains, and the like and more particularly to an apparatus for lifting and folding lengths of sheet material used in a folding blind, shade, and/or curtain.

BACKGROUND OF THE INVENTION

The prior art contains various devices for lifting and folding sheet fabric used as shades, blinds and/or curtains. For example, U.S. Pat. No. 5,072,767 entitled DEVICE FOR FACILITATING THE FOLDING OF A RAISABLE CURTAIN issued to Kraeutler on Dec. 17, 1991, discloses a flexible goods-handling curtain. A plurality of horizontal reinforcing bars disposed vertically along the curtain at regular intervals. Also disposed along the curtain are a plurality of lifting straps. The lifting straps are fixed to the bottom bar and pass through rings fixed to at least some of the other bars. A drive mechanism is provided which includes a shaft disposed above the curtain onto which the straps are wound to lift and fold the curtain.

U.S. Pat. No. 5,199,479 entitled SKID FOR A RAISABLE-CURTAIN GOODS-HANDLING DOOR issued to Kraeutler on Apr. 6, 1993, discloses a folding raisable curtain which includes a plurality of horizontally extending sheaths consisting of double thickness areas of the curtain. A reinforcing bar extends through each sheath. Skids are provided at the ends of each reinforcing bar which limit the lateral movement of the reinforcing bars in the sheaths. Each skid is a semi-cylindrical-shaped member which is fastened to the curtain with rivets placed in holes in the skid. Each skid includes a radial finger directed towards the inside of the sheath which operates as a stop to prevent lateral movement the reinforcing bar.

U.S. Pat. No. 5,207,256 entitled SAFETY DEVICE FOR A RAISABLE CURTAIN DOOR issued to Kraeutler on May 4, 1993, discloses a flexible-lightweight reinforcing bar for a flexible and foldable raisable curtain. The flexible reinforcing bar is located in the lowermost end of the curtain and operates to increase the safety of the bottom edge of the curtain to help avoid personal injury or damage to vehicles and the curtain itself.

U.S. Pat. No. 5,265,373 entitled CURTAIN SYSTEM issued to Vollebregt on Nov. 30, 1993, discloses a curtain system which includes a plurality of support tubes. Clamps are provide for attaching the leading edge of the curtain to the tube. Each clamp includes a pair of spaced apart jaws and a bolt that extends through the clamp to tighten the jaws around a curtain lifting cable. A second pair of resilient jaws on the clamp attach the clamp and a portion of the curtain to the curtain support tube.

U.S. Pat. No. 5,273,096 entitled APPARATUS FOR GRIPPING SHEET FABRIC issued to Thomsen et al. on Dec. 28, 1993, discloses a sheet fabric gripping apparatus for making a foldable blind, shade, or curtain. The apparatus consists of a plurality of tubular members having longitudinal openings therein for accepting sheet material through the grooves. A rod member associated with each tubular member is fitted within the tubular member with a portion of the sheet material looped around it to hold the sheet material between the tubular member and the rod member.

It is an object of the present invention to provide an improved low cost and easy to use apparatus for lifting and folding lengths of sheet material used in a folding blind, shade or curtain.

SUMMARY OF THE INVENTION

An apparatus for lifting and folding a sheet of material used as a window covering, comprising a headrail for attaching the apparatus adjacent to a window; a pair of spaced apart straps extending vertically from the headrail; a plurality of rods extending horizontally between the straps, wherein the rods are operative for affixing the sheet of material to the apparatus; and a first plurality of clips for attaching the sheet of fabric material to the rods, wherein each of the clips includes means for coupling the rods to the straps at a plurality of vertically spaced apart locations along the straps to provide a plurality of folds in the sheet of material.

A second plurality of clips can also be provided for attaching the sheet of material to the ends of the rods while the first plurality of clips are used for attaching the sheet of material at locations remote from the ends of said rods.

BRIEF DESCRIPTION OF THE DRAWINGS

For a detailed understanding of the invention, reference should be made to the following detailed description taken in conjunction with the accompanying drawings wherein.

DETAILED DESCRIPTION OF THE INVENTION

The sheet fabric lifting and folding apparatus of the invention, denoted generally as numeral 10, is applicable to all kinds of shades, blinds, curtains and the like which employ a sheet of foldable fabric material. In the embodiment shown, the lifting and folding apparatus of the invention will be described in conjunction with a folding shade.

Figure 1A:
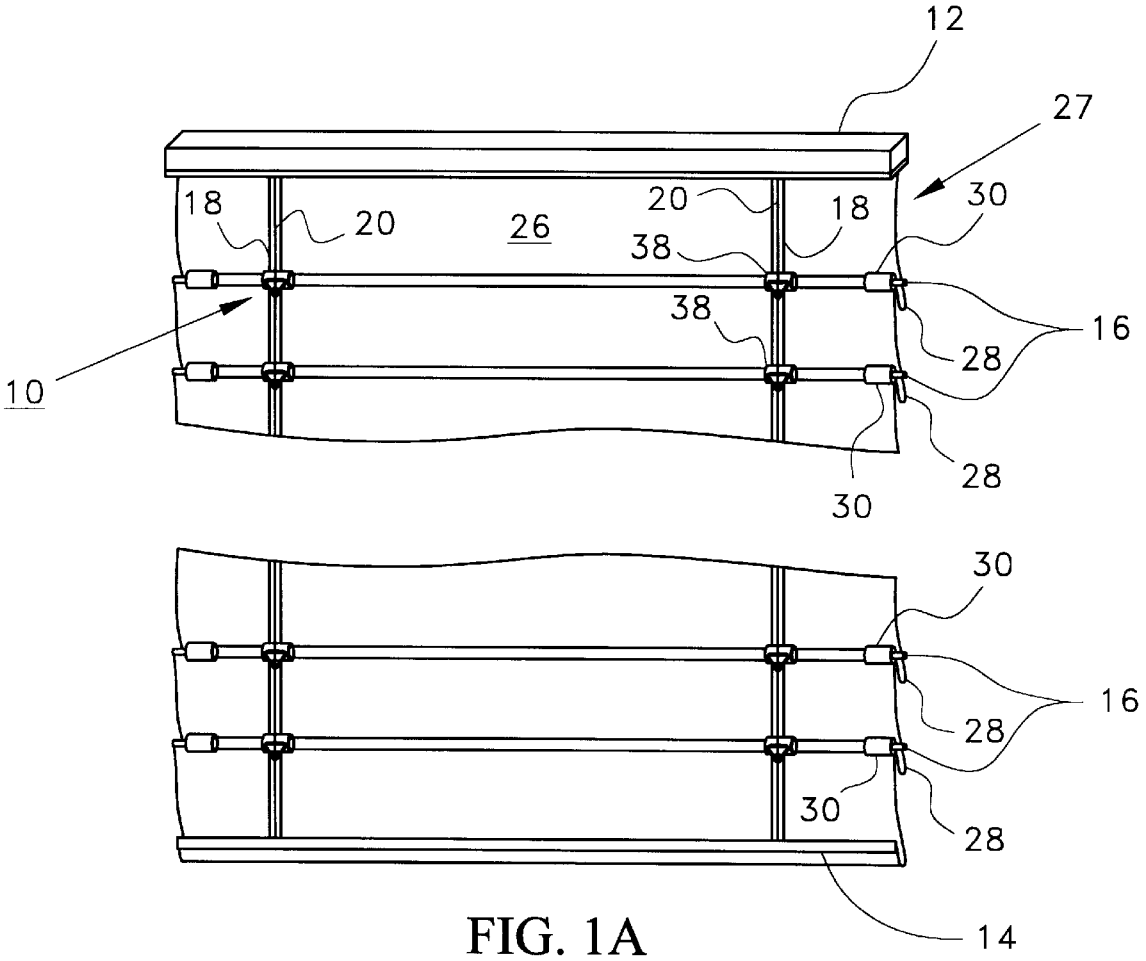
FIG. 1A is a rear elevational view of the invention.
Figure 1C:
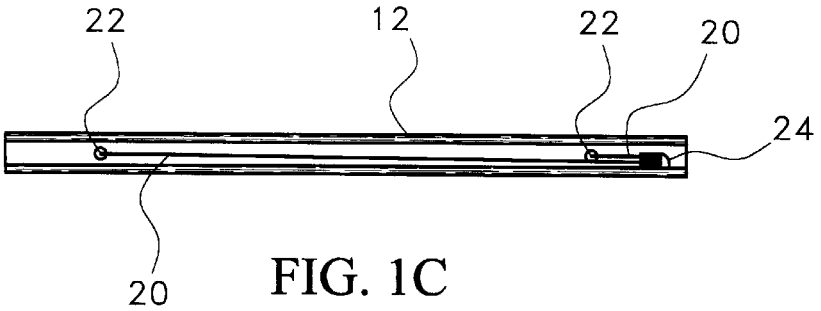
FIG. 1C is a top view of the invention.
Figure 1B:
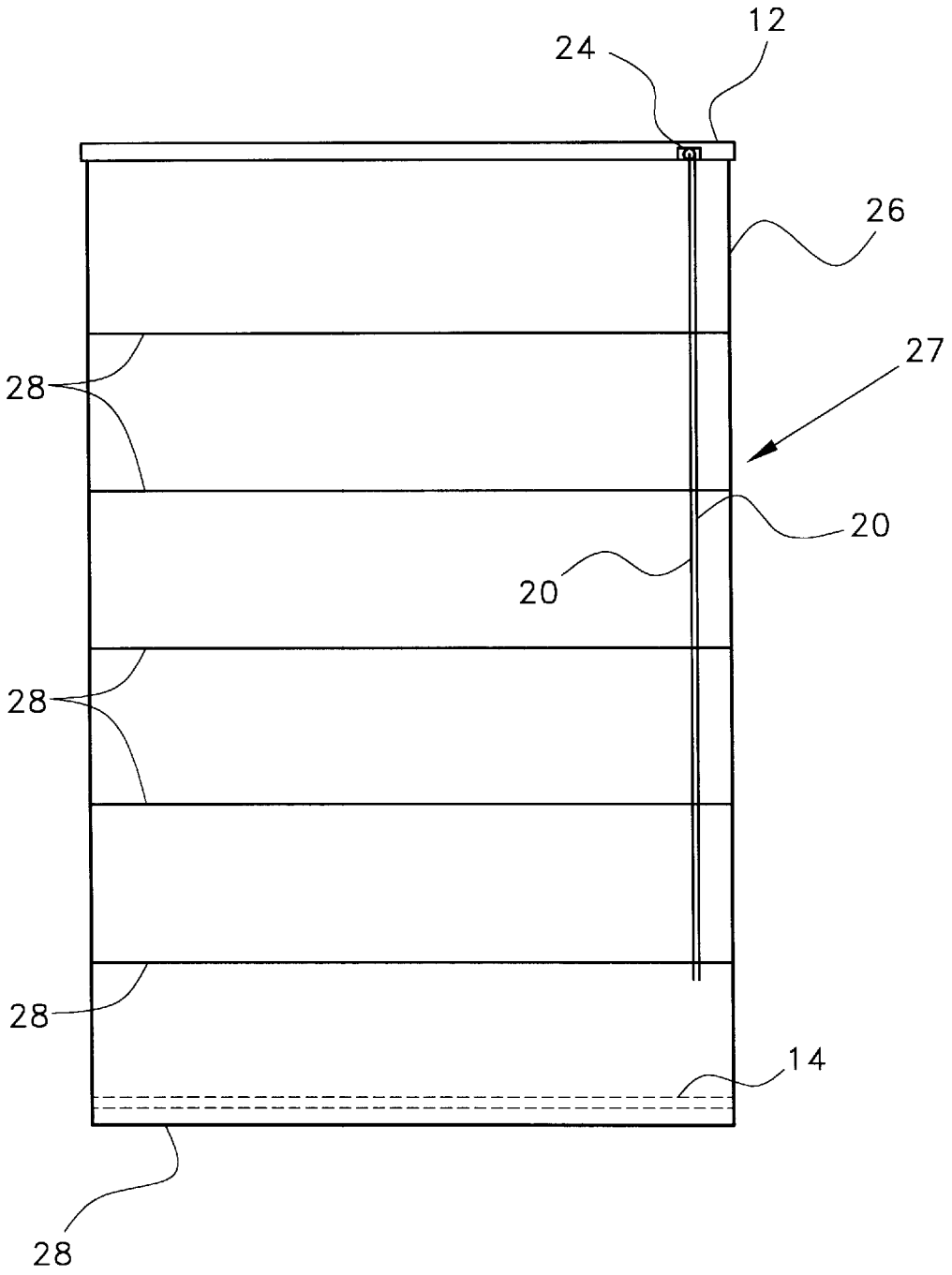
FIG. 1B is a front elevational view of the invention.

Referring collectively to FIGS. 1A–1D, there is shown a sheet of fabric material 26 which makes up a shade 27 that is conventionally attached using staples, an adhesive, or the like, between a headrail 12 and a footrail 14. The headrail 12 and footrail 14 are conventionally constructed from wood or any other suitable material. The folding and lifting apparatus 10 of the invention comprises a pair of straps 18 for holding the entire shade together. As shown in FIG. 1A, each strap 18 has one end attached to the headrail 12 and the other end attached to the footrail 14. The straps 18 are conventionally attached to the headrail 12 and footrail 14 using staples, or any other like technique. A conventional pull cord arrangement is provided for lifting and lowering the shade 27. As shown in FIG. 1C, the pull cord arrangement includes a pair of pull cords 20 each of which has one end attached to the footrail via a staple or the like and the other end passing through an aperture 22 in the bottom of the headrail 12. Both pull cords come together and pass through a conventional pull cord lock 24 disposed in the front surface of the headrail 12 as shown in FIG. 1B. The pull cords 20 allow the shade 27 to be raised or lowered to a desired height and position.

Figure 1D:
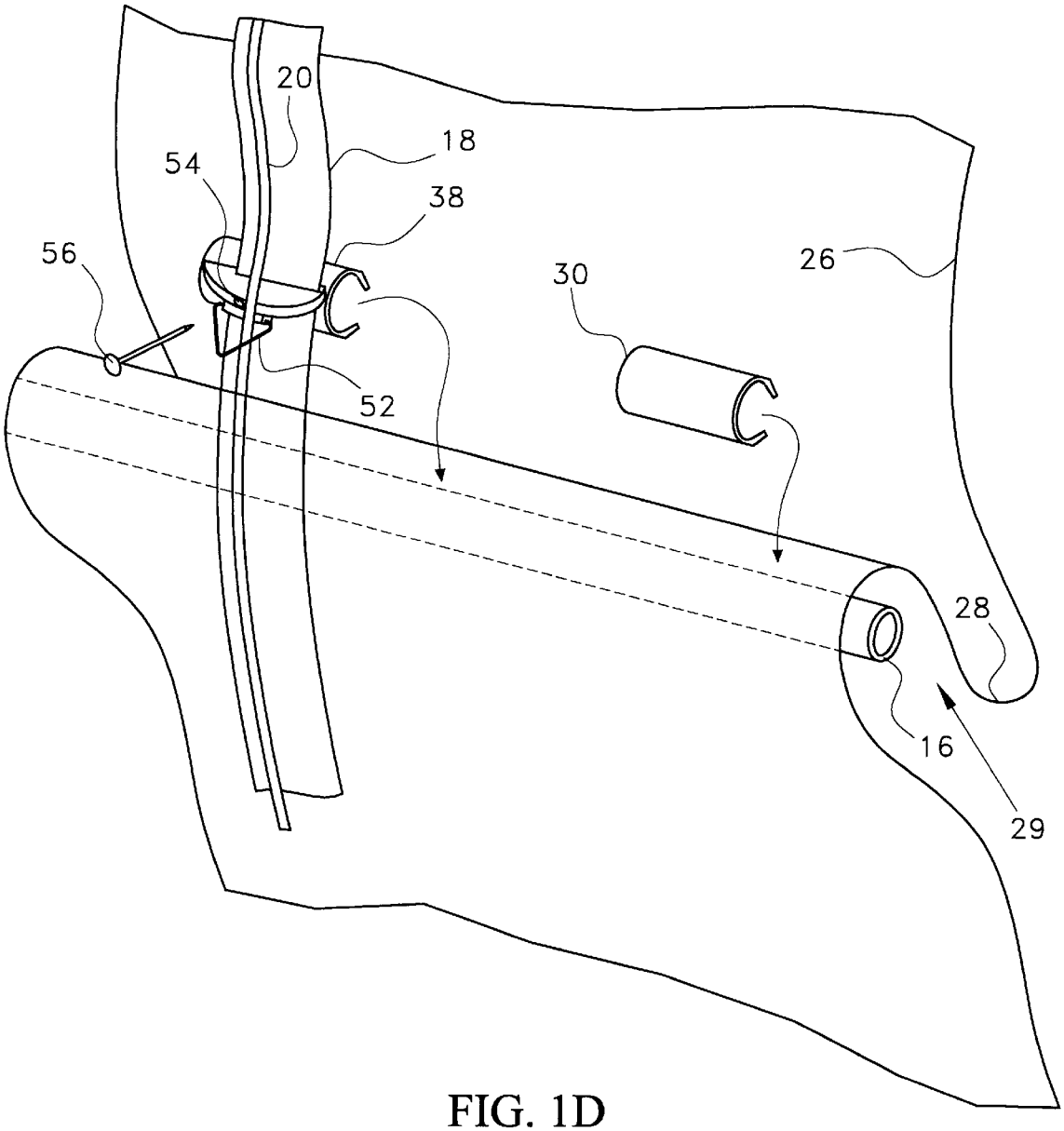
FIG. 1D is a rear perspective view of the invention.

The folding and lifting apparatus 10 of the invention includes a plurality of rods 16 each having a pair of outer clips 30 and a pair of inner clips 38 for attaching the sheet fabric material 26 to the apparatus 10 in a manner which creates a plurality of folds 28 in the sheet fabric material 26 as shown in FIGS. 1A, 1B and 1D. This is accomplished by the inner clips 38 which operate to affix the rods 16 at a predetermined plurality of vertically spaced positions along the straps 18 such that the sheet of fabric material 26 is folded together to create the folds 28 as will be further explained. The outer clips 30 attach the side edges of the sheet fabric 26 to the rods 16 so that the sheet fabric 26 remains looped from the inner clips to the end of the rods 16. The rods 16 are tubular in shape and are preferably made from plastic material which makes the rods 16 relatively light in weight and inexpensive to manufacture by extrusion or like methods. In other embodiments of the invention, the rods can be solid and made from wood if desired. In any case, each rod 16 is positioned within a loop 29 of the sheet fabric material 26. Once the sheet fabric material 26 is looped around the rod 16, the inner clips 38 and outer clips 30 are snapped over the fabric covered rod 16.

Figure 2A:
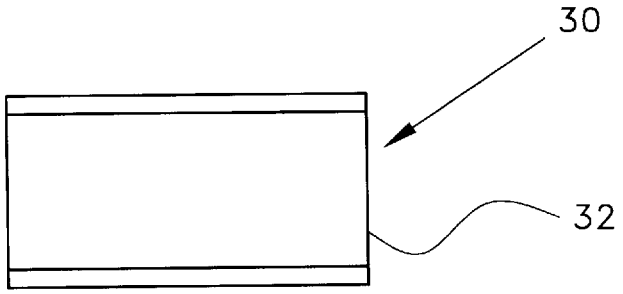
FIG. 2A is front elevational view of the outer clip of the invention.
Figure 2B:
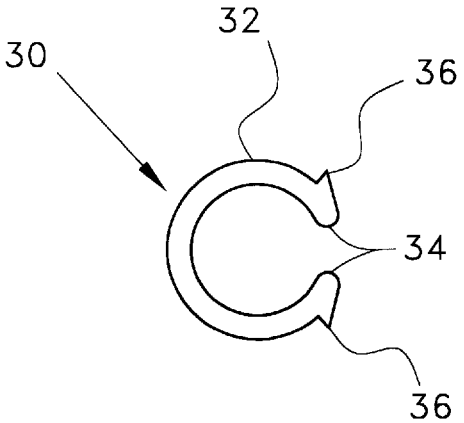
FIG. 2B is side elevational view of the outer clip of the invention.

Referring to FIGS. 2A and 2B, the outer clip 30 has an elongated C-shaped body 32 with spaced apart opposing edges 34 as best seen in FIG. 2B. Each edge 34 includes a flange 36 which reinforces and strengthens the edge 34. The outer clip 30 is preferably made from a resilient plastic material which allows it to open slightly to snap over the fabric covered rod 16. However, the outer clip 30 can be made from any other material which will provide an outer clip that has equivalent mechanical characteristics.

Figure 3A:
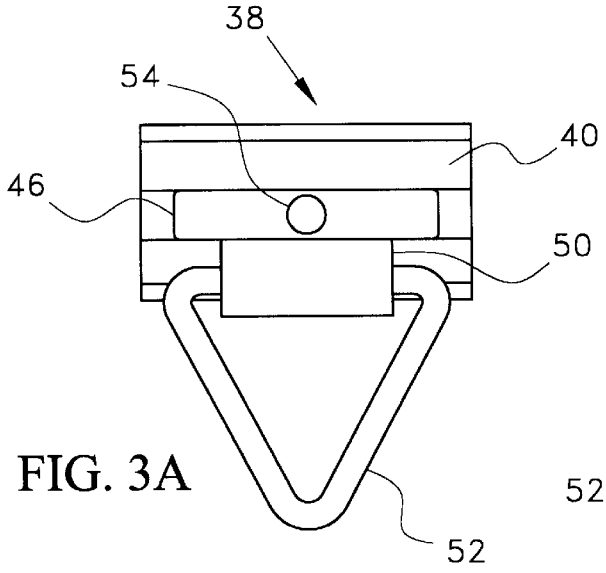
FIG. 3A is a front elevational view of the inner clip of the invention.
Figure 3B:
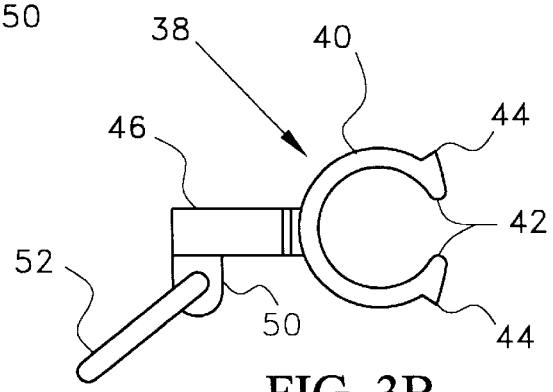
FIG. 3B is a side elevational view of the inner clip of the invention.
Figure 3C:
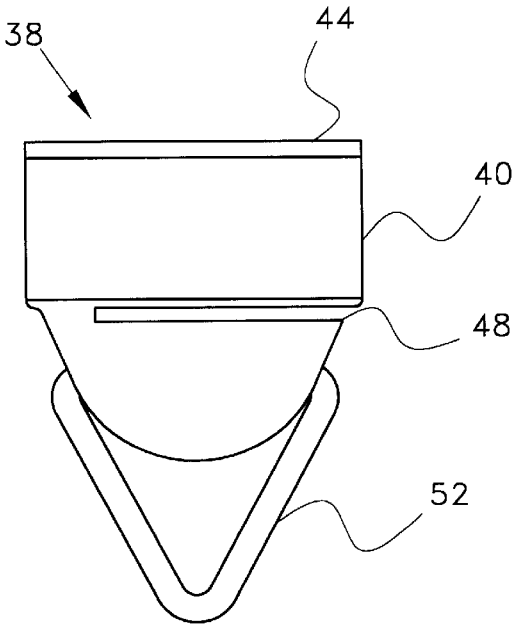
FIG. 3C is a top view of the inner clip of the invention.
Figure 3D:
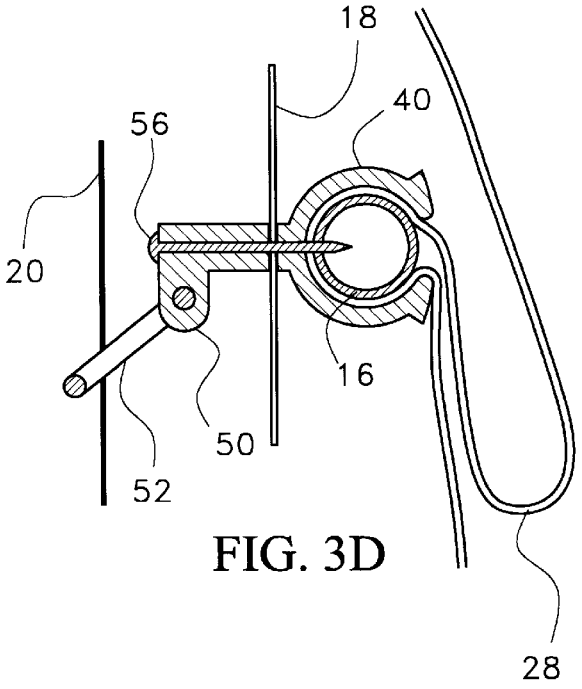
FIG. 3D is a cross-sectional view through the inner clip as it is installed on one of the the rods of the invention.

Referring to FIGS. 3A–3D, the inner clip 38 has an elongated C-shaped body 40 with spaced apart opposing edges 42 similar to the outer clip 30 as best seen in FIG. 3B. Each edge 42 also includes a flange 44 which reinforces and strengthens the edge 42. The inner clip 38 further includes a C-shaped arm 46 extending from the body 40 thereof. As seen in FIG. 3C, a strap receiving slot 48 is defined between the body 40 and the arm 46. An enlarged portion 50 extends from the arm 46 and includes an aperture (not visible) which extends through the enlarged portion 50 in a direction which is parallel to the body 40 for receiving a triangular-shaped ring 52 which is preferably made from a metal. Like the outer clip 30, the inner clip 38 is preferably made from a resilient plastic material which allows the clip to open slightly to snap over the fabric covered rod or any other material which will provide an outer clip that has equivalent mechanical characteristics.

As described earlier, the inner clips 38 affixed the rods 16 to the rods 18 at a predetermined plurality of vertically spaced positions along the straps 18 such that the sheet of fabric material 26 is folded together to create the folds 28. More specifically as shown in FIG. 1D, after the fabric material 26 is looped around one of the rods 16, the strap 18 which runs from the headrail 12 to the footrail 14 is inserted into the slot 48 of the inner clip 38. As shown in both FIGS. 1D and 3D, each inner clip 38 includes an aperture 54 for receiving a pin or nail 56. The aperture 54 passes through the arm 46 and perpendicularly through the body 40 of the inner clip 38. Once the desired fold 28 is located in the fabric material 26 (this is accomplished by sliding the inner clip 38 along the length of the strap 18), the pin 56 is inserted into the aperture 54 of the inner clip 38 so that the pin 56 pass through the strap 18 and into the rod. This arrangement affixes the inner clip 38 to the strap 18 so that the inner clip 38 can no longer be moved along the length of the strap 18 and thus, creates the desired fold 28. Since the inner clip 38 is simultaneously clamped onto the fabric covered rod 16 and the pinned to a predetermined location of the strap 18, the vertical spacing between the rods 16 can be maintained. In this manner, the inner clips 38 in conjunction with the straps 18 firmly hold the entire shade 27 together in a manner which enables the rolling effect of the fabric material 26.

Each pull cord 20 extends through the rings 52 of the inner clips 38 which operate to maintain each pull cord 20 directly behind its associated strap 18 so the straps hide the pull cords 20 when the shade 27 is seen from the front side thereof as shown in FIG. 1B.

In operation, the shade 27 is lifted by pulling on the pull cords 20, which first draws the footrail 14 up toward the first rod 16. The inner clips 38 engage and rest on the footrail 14 thereby allowing the footrail to lift the first rod 16. Pulling further on the pull cords 20 draws the drawn together footrail and rod 16 so the inner clips 38 on the first rod engage and rest on the inner clips 38 of the next rod 16 until all the remaining rods 16 are sequentially drawn together. Accordingly, the lifting and folding apparatus 10 neatly folds the sheet material 26 as the shade 27 is lifted. When the shade 27 is lowered, the above sequence reversed.

It should be understood that the embodiments described herein are merely exemplary and that a person skilled in the art may make many variations and modifications to these embodiments utilizing functionally equivalent elements to those described herein. Any and all such variations or modifications as well as others which may become apparent to those skilled in the art, are intended to be included within the scope of the invention as defined by the appended claims.

What is claimed is:

1. An apparatus for lifting and folding a sheet of material used as a window covering, comprising:

a headrail for attaching said apparatus adjacent to a window;

a pair of spaced apart straps extending vertically from said headrail and fixedly coupled to said headrail and to a footrail; a plurality of rods extending horizontally between said straps, wherein said rods are operative for affixing a sheet of material to said apparatus; and a plurality of clips for attaching the sheet of fabric material to said rods, wherein each of said clips includes means for coupling said rods to said straps at a plurality of vertically spaced apart locations along said straps to provide a plurality of folds in the sheet of fabric material, said means for coupling including an arm extending from said clip, said arm and said clip defining an elongated slot therebetween having an open end for receiving one of said straps, and a pin which extends through said clip, one of said straps and one of said rods.

2. The apparatus according to claim 1, wherein each of said clips is C-shaped.

3. The apparatus according to claim 1, further comprising a pair of pull cords extending vertically from said headrail, each of said pull cords extending adjacent to one of said straps, wherein each of said clips includes a ring pivotally attached thereto for positioning said pull cords behind said straps.

4. The apparatus according to claim 1, further comprising a second plurality of clips for attaching the sheet of material used as a window covering to said rods.

5. The apparatus according to claim 4, wherein said rods have opposing ends, said second plurality of clips for attaching the sheet of material used as a window covering to said ends of said rods and said plurality of clips for attaching the sheet of material used as a window covering at locations remote from said ends of said rods.

6. The apparatus according to claim 4, wherein said second plurality of clips are C-shaped.

7. The apparatus according to claim 1, wherein said slot for receiving one of said straps is operable to receive said one of said straps from either a vertical or a horizontal direction.

8. An apparatus for lifting and folding a sheet of material used as a window covering, comprising:

a headrail for attaching said apparatus adjacent to a window;

a pair of spaced apart straps extending vertically from said headrail and fixedly coupled to said headrail and to a footrail;

a plurality of rods having opposing ends, said rods extending horizontally between said straps, wherein said rods are operative for affixing a sheet of material to said apparatus; and a first plurality of clips for attaching the sheet of material to said rods, wherein each of said clips includes means for coupling said rods to said straps at a plurality of vertically spaced apart locations along said straps to provide a plurality of folds in the sheet of material, said means for coupling including an arm extending from said clip, said arm and said clip defining an elongated slot therebetween having an open end for receiving one of said straps, said slot in parallel alignment to a central longitudinal axis of said clip and one of said rods, and a pin which extends through said clip, one of said straps and one of said rods; and a second plurality of clips for attaching the sheet of material to said ends of said rods.

9. The apparatus according to claim 8, wherein each of said first and second plurality of clips is C-shaped.

10. The apparatus according to claim 8, further comprising a pair of pull cords extending vertically from said headrail, each of said pull cords extending adjacent to one of said straps, wherein each of said first plurality of clips includes a ring pivotally attached thereto for positioning said pull cords behind said straps.

11. The apparatus according to claim 8, wherein said first plurality of clips are for attached the sheet of material used as a window covering at locations remote from said ends of said rods.

12. The apparatus according to claim 8, further comprising a footrail for attaching to an end of the sheet material.

13. The apparatus according to claim 12, wherein said straps extend between said headrail and said footrail.

14. In an apparatus for lifting and folding a sheet of material used as a window covering, said apparatus having a headrail and footrail for attaching the apparatus adjacent to a window, a strap extending vertically from the headrail and fixedly coupled thereto, a rod operative for affixing the sheet of material to said apparatus, and a clip for attaching said sheet of material to said rod, said clip comprising:

a clip body; and means for coupling the rod to the strap to provide a fold in the sheet of material wherein said means for coupling includes an arm extending from said clip body, an elongated slot defined between said clip body and said arm for receiving the strap, said slot having a closed end at an intersection of said arm and said body and an opening extending in a direction which is parallel to said clip body, and a pin which extends through said arm, and slot, and said clip body.

15. The clip according to claim 14, wherein said clip is C-shaped.

* * * * *